US005236465A

United States Patent [19]

Ohashi et al.

[11] Patent Number: 5,236,465

[45] Date of Patent: Aug. 17, 1993

[54] METHOD FOR SHRINK-PROOF TREATMENT OF FABRIC OF KERATINOUS FIBERS WITH ORGANOPOLYSILOXANE COMPOSITIONS

[75] Inventors: Hiroshi Ohashi, Annaka; Yoshio Okamura, Takasaki, both of Japan

[73] Assignee: Shin-Etsu Chemical Co., Ltd., Tokyo, Japan

[21] Appl. No.: 740,423

[22] Filed: Aug. 5, 1991

[30] Foreign Application Priority Data

Aug. 14, 1990 [JP] Japan ..... 2-214668

[51] Int. Cl.[5] ..... D06M 15/38; D06M 15/643

[52] U.S. Cl. ..... 8/128.3; 8/128.1; 8/110; 8/109; 8/107; 8/101; 8/127.5; 427/387

[58] Field of Search ..... 8/128.3, 128.1, 127.5, 8/DIG. 1; 106/18.11, 18.12, 18.14, 18.18; 524/607, 608; 528/26, 29, 33

[56] References Cited

U.S. PATENT DOCUMENTS 4,098,572 7/1978 Smith ..... 8/128 A 5,078,747 1/1992 Kastele et al. ..... 8/181

5,087,266 2/1992 Connell et al. ..... 8/109

*Primary Examiner*—Prince Willis, Jr.

*Assistant Examiner*—John F. McNally

*Attorney, Agent, or Firm*—Wyatt Gerber Burke

[57] ABSTRACT

A very effective method is proposed for the shrink-proof treatment of a fabric material of keratinous fibers, e.g., wool, in which the fabric material is first soaked with an aqueous solution of a persulfate compound followed by drying to effect surface oxidation of the fibers and then finished with a curable organopolysiloxane composition. Preferably, the curable organopolysiloxane composition comprises, as a dispersion in an aqueous medium, (A) an organopolysiloxane having hydroxyl or alkoxyl groups, (B) silica or an organopolysilsesquioxane in a finely divided form, (C) an alkoxy silane having an amido group and a carboxyl group in a molecule, (D) an alkoxy silane having an amino group or an epoxy group in a molecule, and (E) a curing catalyst, each in a specified proportion.

12 Claims, No Drawings

METHOD FOR SHRINK-PROOF TREATMENT OF FABRIC OF KERATINOUS FIBERS WITH ORGANOPOLYSILOXANE COMPOSITIONS

BACKGROUND OF THE INVENTION

The present invention relates to a method for shrink-proof treatment of a fabric material made of keratinous fibers or, in particular, woolen fibers. More particularly, the invention relates to a method for treating a woolen fabric material by which the fabric material can be imparted with excellent shrink resistance and softness in touch lastingly retained even after many times of repeated laundering.

Fabric materials of keratinous fibers or, typically, woolen fibers in general have a serious defect that the fabric material is subject to shrinkage when the fabric material is laundered or washed. This defect is due to the specific scaly surface structure of the fibers which causes intertwinement of the fibers resulting in felting of the fabric material. It is conventionally undertaken therefore that a woolen fabric material is subjected to a shrink-proof treatment and various methods have been proposed or attempted in the prior art.

For example, it is a well known method that the scaly surface structure of wool fibers can be smoothened by a treatment of a woolen fabric material with chlorine so as to decrease intertwinement of the fibers. This method, however, is not quite satisfactory because the effect of the chlorine treatment cannot be always very uniform and, in addition, yellowing sometimes takes place in the woolen fabric materials after chlorine treatment to greatly decrease the aesthetic value of beautiful color tone to be obtained by dyeing.

Alternatively, woolen fabric materials are treated with a certain urethane resin so that the scaly surface of the woolen fibers is coated with a coating layer of the resin to be smoothened resulting in a decrease in the shrinkage of the fabric material by laundering. This method, however, has a problem that the softness of the fabric material as a feature inherent in wool products is greatly decreased and the fabric material is stiffened by the treatment.

Despite the problems above mentioned, these methods are widely practiced in the industry of wool products because the shrink-proof effect obtained by these methods is high enough and, in particular, the effect is durable to be retained even after repeated laundering.

With an object to obtain a shrink-proof effect of woolen fabric materials without a decrease in the soft feeling of touch of the fabric material, proposals have been made for the shrink-proof treatment of woolen fabric materials with a silicone-based shrink-proof agent. Methods by using various types of silicone-based shrink-proof agents are known in the prior art including a method by using a composition comprising a solution of an organopolysiloxane of a straightly linear molecular structure terminated at each molecular chain end with a silanolic hydroxy group and having a viscosity of at least 50 centistokes at 25° C. and a methyl hydrogen polysiloxane dissolved in an organic solvent with admixture of a curing catalyst as is disclosed in Japanese Patent Publication 48-33435, a method in which the silicone-based shrink-proof agent is a composition comprising a diorganopolysiloxane having amino groups and alkoxy groups in a molecule as is disclosed in Japanese Patent Publication 53-28468, a method in which the silicone-based shrink-proof agent is a composition comprising an organopolysiloxane having amino groups and mercapto groups in a molecule as is disclosed in Japanese Patent Publication 58-4114, and so on.

At any rate, these prior art methods by using a silicone-based shrink-proof agent are not always quite satisfactory in respect of the durability of the shrink-proof effect even though a high shrink-proof effect can be obtained directly after the treatment. Namely, the shrink-proof effect imparted to the fabric material by the treatment is rapidly lost by repeating laundering. In addition, the woolen fabric material treated with these silicone-based shrink-proof agents is disadvantageous because of the loss of the soft and pleasant feeling of touch as a result of the silicone treatment.

An improved method is disclosed recently in Japanese Patent Kokai 2-84579 according to which the fibers of a woolen fabric material are subjected to surface oxidation by the treatment with chlorine followed by the treatment of surface coating with an amino-modified silicone resin. This method indeed is effective to a considerable extent to solve the above described problems in the shrink-proof treatment of woolen fabric materials though far from satisfactory.

Thus, it is eagerly desired to develop a reliable method for the shrink-proof treatment of a woolen fabric material capable of imparting the fabric material with highly laundering-resistant shrink-proofness and very pleasant soft feeling of touch without causing yellowing.

SUMMARY OF THE INVENTION

The present invention accordingly has an object to provide a novel and reliable method for the shrink-proof treatment of a fabric material of keratinous fibers which is capable of imparting the fabric material with highly laundering-resistant shrink-proofness and very pleasant soft feeling of touch without causing yellowing.

Thus, the method of the invention for the shrink-proof treatment of a fabric material of keratinous fibers comprises the successive steps of:

(a) soaking the fabric material with an aqueous solution containing a persulfate compound dissolved therein to effect surface oxidation of the fibers followed, if necessary, by drying; and (b) soaking the thus persulfate-treated fabric material with a curable organopolysiloxane composition followed by drying and heating to effect curing of the composition on the surface of the fibers.

In particular, best results of the shrink-proof treatment could be obtained in the above described method when the curable organopolysiloxane composition, which preferably is in the form of an aqueous emulsion or dispersion, is a composition which comprises:

(A) 100 parts by weight of an organopolysiloxane having, in a molecule, at least two hydroxyl or alkoxyl groups bonded to the silicon atoms;

(B) from 0.5 to 50 parts by weight of a silica or an organopolysilsesquioxane in a finely divided form;

(C) from 0.1 to 20 parts by weight of an alkoxy silane compound having an amido group and a carboxyl group in a molecule represented by the general formula $$HOOC—R^1—CO—NH—R^2SiR^3_a(OR^4)_{3-a}, \quad (I)$$

in which $R^1$ and $R^2$ are each a divalent hydrocarbon group having 1 to 8 carbon atoms, $R^3$ and $R^4$ are each a monovalent hydrocarbon group having 1 to 20 carbon atoms and the subscript a is 0 or 1;

(D) from 0.1 to 20 parts by weight of an aminoalkyl-containing alkoxy silane compound represented by the general formula $$R^4R^5N\leftarrow R^6-NR^7\rightarrow_b R^8SiR^9_c(OR^{10})_{3-c}, \quad \text{(II)}$$

in which $R^4$, $R^5$ and $R^7$ are each a hydrogen atom or a monovalent hydrocarbon group having 1 to 20 carbon atoms, $R^6$ and $R^8$ are each a divalent hydrocarbon group having 1 to 8 carbon atoms, $R^9$ and $R^{10}$ are each a monovalent hydrocarbon group having 1 to 20 carbon atoms, the subscript b is 0, 1, 2 or 3 and the subscript c is 0 or 1, or an epoxy group-containing alkoxy silane compound represented by the general formula $$Ep-R^{11}SiR^{12}_d(OR^{13})_{3-d}, \quad \text{(III)}$$

in which Ep is an epoxy group, $R^{11}$ is a divalent hydrocarbon group having 1 to 8 carbon atoms, optionally, including a hetero atom, e.g., oxygen atom, between carbon atoms, $R^{12}$ and $R^{13}$ are each a monovalent hydrocarbon group having 1 to 20 carbon atoms and the subscript d is 0 or 1; and (E) from 0.01 to 10 parts by weight of a curing catalyst.

DETAILED DESCRIPTION OF THE PREFERRED EMBODIMENTS

As is understood from the above given description, the most characteristic feature of the inventive method consists in the surface-oxidation treatment of the keratinous fibers in step (a) with an aqueous persulfate solution which should precede the coating treatment of the fibers with a curable organopolysiloxane composition. It is a quite unexpected discovery that this pretreatment of surface oxidation of the keratinous fibers with a specific oxidizing agent has a remarkable effect of increasing durability of the shrink-proofness imparted by the silicone treatment so as to retain the shrink-proofness even after many times of repeated laundering along with an effect of improving the softness of the keratinous fabric materials.

The keratinous fibers, of which the fabric material subjected to the shrink-proof treatment according to the inventive method, include not only fibers of wool as a typical one but also fibers of cashmere, mohair, alpaca and any other animal hairs after refinement provided that the surface of the fibers has a scaly structure. The type of the fabric material is also not limitative including yarns, woven fabrics, knit cloths, non-woven fabrics and the like.

In step (a) of the inventive method, the fabric material is subjected to a treatment of surface oxidation by using an aqueous solution of a persulfate compound as an oxidizing agent. The persulfate compound used as the oxidizing agent in step (a) is exemplified by sodium persulfate, potassium persulfate and ammonium persulfate though not particularly limitative thereto provided that the persulfate compound is water-soluble. The aqueous persulfate solution used in step (a) usually contains from about 5% to about 10% by weight of the persulfate dissolved therein though not particularly limited thereto. When the concentration thereof is too low, an increased length of time would be taken to obtain the desired effect of surface oxidation. When the concentration of the persulfate is too high, on the other hand, certain adverse influences are caused on the mechanical properties of the fibers or in the feeling of touch of the fabric materials due to the excessively high surface oxidation. The aqueous persulfate solution should preferably have a controlled pH value of 2 to 5 depending on the kind of the keratinous fibers by the addition of a suitable acid such as formic acid and acetic acid. It is also optional that the aqueous persulfate solution is admixed with a penetrating agent such as a surface active agent in order to accelerate proceeding of the treatment.

To conduct step (a) of the inventive method, the fabric material is first soaked with the aqueous persulfate solution, conveniently, by immersing the fabric material in the solution. The amount of the aqueous persulfate solution should be sufficiently large to be, for example, at least 5 times by weight of the fabric material immersed therein. The length of time for which the fabric material is kept in contact with the persulfate solution naturally depends on the concentration of the persulfate in the aqueous solution, temperature and other factors but it is usually sufficient to immerse the fabric material in the solution for 30 to 60 minutes at room temperature. It is optional to increase the temperature of the solution so as to shorten the time taken for the treatment. After completion of immersion in the persulfate solution, the fabric material is freed from the persulfate solution by washing with water or, preferably, with hot water followed by drying, if necessary, with heating. When the persulfate solution is acidic by the addition of an acid as is mentioned above, washing with water is preferably preceded by neutralization using a dilute solution of an alkali such as sodium carbonate and sodium hydrogencarbonate.

Although the exact mechanism is unknown for the unexpectedly improved durability of the effect of the shrink-proof treatment by undertaking this surface-oxidation pre-treatment of the fabric material with an aqueous persulfate solution, it is presumable that the surface of the keratinous fibers is adequately oxidized so as to be imparted with increased affinity with the curable organopolysiloxane composition.

The fabric material after step (a) is then subjected to a treatment with a curable organopolysiloxane composition which is usually or preferably in the form of an aqueous dispersion or emulsion although a solution or dispersion of the composition in an organic solvent also can be used. The type of the curable organopolysiloxane composition is not particularly limitative provided that the composition can be cured on the surface of the keratinous fibers either at room temperature or at an elevated temperature. For example, a composition consisting of an organopolysiloxane having three or more of alkoxy groups bonded to the silicon atoms in a molecule and a curing catalyst such as dioctyltin dilaurate is quite satisfactory in respect of the shrink-resistance. It is preferable that the organopolysiloxane as the principal ingredient in the curable organopolysiloxane composition has at least one reactive group such as carboxyl, amido, amino and epoxy groups having an effect to further improve the affinity between the fiber surface and the cured organopolysiloxane composition.

When it is important that the fabric material after the treatment according to the inventive method is imparted with full softness inherent in woolen fibers, the curable organopolysiloxane composition is preferably a composition comprising:

(A) 100 parts by weight of an organopolysiloxane having, in a molecule, at least two hydroxyl groups or alkoxyl groups bonded to the silicon atoms;

(B) from 0.5 to 50 parts by weight of a silica or an organopolysilsesquioxane in a finely divided form;

(C) from 0.1 to 20 parts by weight of an alkoxy silane compound having an amido group and a carboxyl group in a molecule represented by the above given general formula (I);

(D) from 0.1 to 20 parts by weight of an alkoxy silane compound having an amino group in a molecule represented by the above given general formula (II) or an alkoxy silane compound having an epoxy group in a molecule represented by the above given general formula (III); and (E) from 0.01 to 10 parts by weight of a curing catalyst.

The organopolysiloxane as the component (A) must contain, in a molecule, at least two hydroxyl groups or alkoxyl groups bonded to the silicon atoms in order that the molecules thereof can be crosslinked to form a cured layer on the fiber surface. These reactive groups can be bonded to the silicon atoms at any positions in the molecules of the organopolysiloxane including not only the silicon atoms at the molecular chain ends but also those at any intermediate position in the molecular chain. The molecular structure of the organopolysiloxane is also not limitative including straightly linear, branched and cyclic structures although a linear molecular structure is preferred in respect of the softness of the fabric material after treatment. It is also preferable in respect of the softness of the fabric material after treatment that the organopolysiloxane has at least one aminoalkyl group bonded to the silicon atom in a molecule. Two kinds or more of organopolysiloxanes of different types can be used in combination according to need.

The method for the preparation of the above described organopolysiloxane is well known in the art of silicones. For example, a cyclic diorganosiloxane oligomer such as octamethyl cyclotetrasiloxane is mixed with an appropriate amount of an oligomeric $\alpha,\omega$-dihydroxy diorganopolysiloxane or an alkoxy-containing organosilane compound and the mixture is heated in the presence of an alkali catalyst such as alkali hydroxides to effect the ring-opening siloxane rearrangement reaction for polymerization to establish equilibrium so that the resultant organopolysiloxane is a diorganopolysiloxane of a linear molecular structure having silicon-bonded hydroxyl groups or alkoxyl groups, respectively. When an aminoalkyl alkoxy silane is contained in the above mentioned reaction mixture, the resultant organopolysiloxane may have aminoalkyl groups bonded to the silicon atoms.

In the preparation of the treatment bath used in step (b) of the inventive method, it is preferable that the organopolysiloxane as the component (A) is emulsified into an aqueous emulsion before compounding with the other components. Such as aqueous emulsion can be easily prepared by vigorously agitating the organopolysiloxane in an aqueous medium containing a surface active agent of which the type is not particularly limitative. When the aqueous emulsion is prepared by using a cationic surface active agent, the adsorptivity of the composition on to the fiber surface can be somewhat improved. On the other hand, an aqueous emulsion prepared by using an anionic or non-ionic surface active agent would have improved compatibility with other anionic additives or anionic fiber-finishing agents.

Alternatively, an aqueous emulsion of an organopolysiloxane can be prepared by the in situ polymerization of an oligomeric starting material or materials emulsified in an aqueous medium prior to polymerization. This process of emulsion polymerization is also well known in the art of silicones. For example, a mixture of a cyclic diorganosiloxane oligomer, e.g., octamethyl cyclotetrasiloxane, alkoxy-containing organosilane compound and, optionally, aminoalkyl alkoxy silane compound is first emulsified in an aqueous medium by using a cationic surface active agent and then the aqueous emulsion is admixed with a catalyst such as an alkali hydroxide to start the in situ polymerization in the emulsion.

The above mentioned alkoxy-containing organosilane compound is represented by the general formula $R_xSi(OR')_{4-x}$, in which R is a monovalent hydrocarbon group having 1 to 20 carbon atoms, R' is a monovalent hydrocarbon group having 1 to 6 carbon atoms and the subscript x is zero, 1 or 2. It is optional that two kinds or more of such organosilane compounds are used in combination according to need. Examples of the alkoxy-containing organosilane compound include dimethyl dimethoxy silane, methyl triethoxy silane, ethyl trimethoxy silane, methyl phenyl dimethoxy silane, methyl tributoxy silane, tetraethoxy silane and the like.

The amino-containing alkoxy silane, which is used preferably in combination with the above described alkoxy silane compound, is represented by the general formula $AR_ySi(OR')_{3-y}$, in which R and R' each have the same meaning as defined above, A is a group represented by the general formula $—R^8—(NR^7—R^6)_nNR^4R^5$, $R^6$ and $R^8$ each being a divalent hydrocarbon group having 1 to 8 carbon atoms, $R^4$, $R^5$ and $R^7$ each being a hydrogen atom or a monovalent hydrocarbon group having 1 to 20 carbon atoms and n being 0 or a positive integer of 1 to 4, and the subscript y is 0, 1 or 2. It is of course optional to use two kinds or more of such amino-containing alkoxy silane compounds in combination. Examples of suitable aminoalkyl-containing alkoxy silane compounds include those expressed by the following structural formulas:

$H_2NC_3H_6Si(Me)(OEt)_2$;

$H_2NC_2H_4NHC_3H_6Si(OMe)_3$;

$Me_2NC_3H_6Si(OPr)_3$;

$C_{12}H_{25}NHC_2H_4NHC_3H_6Si(OMe)_3$;

$(PhCH_2)(Me)NC_4H_8NHC_4H_8Si(Me)(OMe)_2$; and $H_2NC_2H_4NHC_2H_4NHC_3H_6Si(OEt)_3$, in which Me is a methyl group, Et is an ethyl group, Pr is a propyl group and Ph is a phenyl group.

The component (B) in the organopolysiloxane composition is silica or an organopolysilsesquioxane in a finely divided form which serves as a reinforcing agent of the cured coating film of the organopolysiloxane composition on the fiber surface. It is preferable that the finely divided powder of silica or an organopolysilsesquioxane is prepared in the form of an aqueous dispersion before it is compounded with the organopolysiloxane as the component (A) which is used preferably in the form of an aqueous emulsion. In this regard, commercially available, so-called "colloidal silica" products in the form of an aqueous dispersion are usually satisfactory for the purpose. It is of course that an aqueous dispersion of a finely divided powder of silica or an organopolysilsesquioxane can be prepared by dispersing the powder prepared in advance in an aqueous medium containing a surface active agent. Alternatively, an aqueous dispersion of a finely divided powder of silica or an organopolysilsesquioxane can be prepared by the in situ hydrolysis of a corresponding silane compound followed by the silanol condensation in an aqueous medium. Thus, for example, an alkoxy silane compound represented by the general formula $R''_zSi(OR')_{4-z}$, in which R' has the same meaning as defined above, R'' is a monovalent hydrocarbon group having 1 to 20 carbon atoms unsubstituted or substituted with epoxy, amino, carboxyl, hydroxyl, cyano and/or (meth)acryloxy groups, and the subscript z is 0 or 1, either alone or in combination of two kinds or more, is emulsified in an aqueous medium containing a surface active agent followed by the admixture of the emulsion with a catalyst such as an alkali metal hydroxide to effect the hydrolysis and silanol condensation of the alkoxy silane compound in the emulsion to form silica or an organopolysilsesquioxane in situ.

The amount of the component (B) in the organopolysiloxane composition used in the inventive method is usually in the range from 0.5 to 50 parts by weight or, preferably, from 1 to 30 parts by weight per 100 parts by weight of the component (A). When the amount of the component (B) is too small, the desired reinforcing effect for the cured coating film of the composition on the fiber surface cannot be fully exhibited so that the durability of the shrink-proofness obtained by the treatment would be decreased. When the amount thereof is too large, on the other hand, the cured film of the composition would be too brittle so as also to decrease the durability of the effect obtained by the treatment. It is optional that two kinds or more of finely divided powders of silica or organopolysilsesquioxanes are used in combination according to need.

The component (C) in the organopolysiloxane composition used in the inventive method is an organo alkoxy silane compound having an amido group and a carboxyl group in a molecule represented by the above given general formula (I). A partial hydrolysis-condensation product of such a silane compound can also be used. This component serves to increase the adhesive bonding strength between the surface of the keratinous fibers and the cured coating film of the organopolysiloxane composition.

The above defined silane compound or partial hydrolysis-condensation product thereof as the component (C) can be prepared by the reaction of an aminoalkyl alkoxy silane compound or a partial hydrolysis-condensation product thereof with an anhydride of a polybasic carboxylic acid. The aminoalkyl alkoxy silane compound to react with the acid anhydride can be exemplified by those shown before as the modifying agent of the organopolysiloxane as the component (A) and is represented by the general formula $AR_ySi(OR')_{3-y}$, in which each symbol has the same meaning as defined before. The polybasic or dibasic carboxylic acid forming an anhydride to react with the above mentioned aminoalkyl alkoxy silane compound or a partial hydrolysis-condensation product thereof is exemplified by phthalic acid, succinic acid, methyl succinic acid, maleic acid, glutaric acid, itaconic acid and the like though not particularly limitative thereto. The reaction between the above described two reactants can readily proceed even at room temperature in a solution of the reactant compounds in a good solvent therefor such as an alcohol. The reaction is complete usually within 1 to 5 hours under agitation at room temperature. The amount of the acid anhydride is preferably at least equimolar to the NH groups in the aminoalkyl alkoxy silane compound or a partial hydrolysis-condensation product thereof because the reaction product used as the component (C) should have at least one amido group and at least one carboxyl group in a molecule.

The amount of the component (C) in the organopolysiloxane composition is in the range from 0.1 to 20 parts by weight or, preferably, from 0.5 to 10 parts by weight per 100 parts by weight of the organopolysiloxane as the component (A). It is optional that two kinds or more of the compounds of different types to meet the definition of the component (C) are used in combination according to need. When the amount of the component (C) is too small, no sufficiently high improvement can be obtained in the adhesive bonding strength between the fiber surface and the cured coating film of the organopolysiloxane composition. When the amount of the component (C) is too large, on the other hand, the fabric material after the treatment with the composition would have a somewhat decreased softness of touch.

The component (D) in the organopolysiloxane composition used in the inventive method is an alkoxy silane compound having an amino group or an epoxy group in a molecule as represented by the above given general formulas (II) and (III), respectively. This component serves as a crosslinking agent of the organopolysiloxane as the component (A) along with an adhesion-improving effect between the fiber surface and the cured coating film of the organopolysiloxane composition. The amino group or epoxy group is also effective to improve softness of the fabric material finished according to the inventive method.

Examples of the silane compound suitable as the component (D) include 3-aminopropyl triethoxy silane, N-(2-aminoethyl)3-aminopropyl methyl dimethoxy silane, N-cyclohexyl-3-aminopropyl trimethoxy silane, 3-morpholinopropyl methyl dimethoxy silane, 3-glycidyloxypropyl trimethoxy silane, 2-(3,4-epoxycyclohexyl)ethyl methyl dimethoxy silane and the like though not particularly limitative thereto.

The above described organosilane compounds as the component (D) can be used either singly or as a combination of two kinds or more according to need. The amount of the component (D) in the organopolysiloxane composition used in the inventive method is in the range from 0.1 to 20 parts by weight or, preferably, from 0.5 to 10 parts by weight per 100 parts by weight of the organopolysiloxane as the component (A). When the amount of the component (D) is too small, the crosslinking density in the cured composition would be insufficient not to exhibit full mechanical strength of the cured coating film so that the durability of the improvement obtained by the inventive method would be decreased. When the amount of the component (D) is too large, on the other hand, the cured coating film on the surface is imparted with increased rigidity due to the overly large crosslinking density so that the fabric material after the treatment would have decreased softness.

The component (E) in the organopolysiloxane composition used in the inventive method is a curing catalyst which promotes the crosslinking reaction of the organopolysiloxane with the crosslinking agent to effect curing of the composition. Examples of suitable curing catalysts include metal salts of an organic acid such as dibutyl tin dilaurate, dioctyl tin dilaurate, dibutyl tin diacetate, tin octoate, iron octoate, zinc octoate and the like and amines and related compounds such as n-hexylamine, guanidine and the like though not particularly limitative thereto. It is preferable that these compounds used as the component (E) are emulsified in an aqueous medium before compounding with the other ingredients to prepare the organopolysiloxane composition. It is optional that two kinds or more of these curing catalysts are used in combination according to need.

The amount of the component (E) added to the organopolysiloxane composition naturally depends on the desired curing velocity but is usually in the range from 0.01 to 10 parts by weight or, preferably, from 0.1 to 5 parts by weight per 100 parts by weight of the organopolysiloxane as the component (A). When the amount of the curing catalyst is too small, the crosslinking reaction cannot proceed to completeness so that no sufficient shrink-proofness can be imparted to the fabric material treated with the composition. When the amount of the curing catalyst is too large, on the other hand, the cured coating film on the fiber surface would be too rigid to decrease softness of the fabric material treated with the composition along with certain adverse influences caused by the residual amount of the catalyst contained in the finished fabric material.

The organopolysiloxane composition used in the inventive method can be prepared by blending the above described components (A) to (E), preferably, each in the form of an aqueous emulsion or dispersion, when it is insoluble in water, or an aqueous solution, when it is water-soluble, in a specified amount. In particular, the component (C), which is a reaction product of an aminoalkyl alkoxy silane compound with an acid anhydride, is obtained usually in the form of an alcoholic solution as a result of the reaction carried out in an alcohol as the solvent. When such an alcoholic solution is directly blended with the aqueous emulsion of the component (A), a detrimental phenomenon may be caused that the emulsion of the organopolysiloxane is destroyed resulting in separation into layers. A recommendable way to avoid this disadvantage is that the alcoholic solution of the component (C) is first blended with the aqueous dispersion of silica or an organopolysilsesquioxane as the component (B) so that a mixture of the components (B) and (C) can be safely obtained in a mixed medium of water and an alcohol, which can be subsequently mixed with the aqueous emulsion of the organopolysiloxane as the component (A) without the problem of separation into layers. The components (D) and (E), which may be insoluble or soluble in water, can be successively added either directly or in the form of an aqueous emulsion to the mixture of the above mentioned mixture of the components (A), (B) and (C).

It is optional that the treatment bath of the organopolysiloxane composition used in step (b) of the inventive method is further admixed with various kinds of additives known in fabric-finishing agents including preservatives, antistatic agents, penetrating agents, flame retardants, water-repellents and the like each in a limited amount.

The amount of the organopolysiloxane composition comprising the components (A) to (E) to be deposited on the surface of the keratinous fibers should be adjusted in the range from 0.5 to 10% by weight based on the amount of the keratinous fibers by controlling the amount of the treatment bath soaking the fabric material in order to fully obtain shrink-proofness with durability against laundering and softness of the fabric material after the treatment. The fabric material soaked with the treatment bath of the organopolysiloxane composition can be dried at room temperature followed by standing as such without heating so that the curing reaction gradually proceeds to exhibit the desired effects. It is, however, advantageous from the standpoint of productivity that the fabric material soaked with the treatment bath is dried by heating at 90° to 100° C. for 2 to 5 minutes followed by a heat treatment at 140° to 160° C. for 2 to 5 minutes to complete the crosslinking reaction.

In the following, the method of the invention is described in more detail by way of examples, in which the terms of "%" and "parts" always refer to "% by weight" and "parts by weight", respectively, excepting the expression for the % shrinkage of the fabric material which naturally refers to the length.

EXAMPLE 1

(1) Persulfate treatment of woolen fabric

An aqueous persulfate solution was prepared by dissolving potassium persulfate and a polyoxyethylene layryl ether as a penetrating agent in amounts to give concentrations of 6.0% and 0.3%, respectively, after adjustment of the pH value to 3.0 with addition of formic acid. An all-wool woven cloth after refinement was immersed in this persulfate solution at 25° C. for 40 minutes in a bath ratio of 50:1 by weight. The thus persulfate-treated wool cloth was then transferred into an aqueous solution of sodium carbonate having a pH of 9.0 and neutralized by keeping therein at 25° C. for 20 minutes followed by washing with hot water at 40° C. for 10 minutes and drying at 100° C. for 3 minutes.

(2) Preparation of an aqueous emulsion of component (A)

Separately, an aqueous emulsion of an organopolysiloxane as the component (A) of the composition for the treatment in step (b) of the inventive method was prepared by the in situ polymerization method in an aqueous emulsion. Thus, a mixture consisting of 500 parts of octamethyl cyclotetrasiloxane, 25 parts of methyl trimethoxy silane, 455 parts of water and 10 parts of dodecylbenzene sulfonic acid was emulsified by vigorously agitating using a homomixer and then passing twice through a homogenizer under a pressure of 3000 psi to give a stable emulsion which was heated at 70° C. for 12 hours to effect the polymerization reaction. After cooling to room temperature and standing for 24 hours, the emulsion was neutralized with sodium carbonate to have a pH of 7.0. The thus obtained emulsion of the dimethyl polysiloxane, referred to as the emulsion A-I hereinbelow, contained 47.2% of nonvolatile matter.

(3) Preparation of a solution of component (C)

Into a reaction vessel equipped with a thermometer, reflux condenser, stirrer and dropping funnel were introduced 98 parts of maleic anhydride and 319 parts of ethyl alcohol to form a solution into which 221 parts of 3-aminopropyl triethoxy silane were added dropwise at room temperature through the dropping funnel taking 1 hour under agitation and agitation of the mixture in the vessel was continued for further 1 hour after completion of the dropwise addition of the silane compound. The thus obtained clear and light yellow solution, referred to as the solution C hereinbelow, contained 48.5% of non-volatile matter.

(4) Preparation of an aqueous emulsion of component (E)

An aqueous emulsion, referred to as the emulsion E hereinbelow, was prepared by vigorously agitating a mixture of 300 parts of dioctyl tin dilaurate, 50 parts of polyoxyethylene nonylphenyl ether and 650 parts of water by using a homomixer.

(5) Preparation of organopolysiloxane composition

Into a 100 parts portion of a commercially available colloidal silica dispersion containing 40% of silica (Snowtex 40, a product by Nissan Chemical Co.), referred to as the dispersion B-I hereinbelow, were gradually added 20 parts of the solution C under agitation which was continued for further 15 minutes to give a homogeneous dispersion containing the components (B) and (C).

A 50 parts portion of the thus obtained dispersion of the components (B) and (C) was gradually added under agitation to 1000 parts of the emulsion A-I followed by the addition of 3 parts of 3-glycidyloxypropyl trimethoxy silane, referred to as the silane D-I hereinbelow, and 15 parts of the emulsion E and agitation was continued for further 15 minutes to give an aqueous dispersion of the organopolysiloxane composition, referred to as the composition I hereinbelow, which contained 43.0% of non-volatile matter. The weight proportion of the components (A):(B):(C):(D):(E) in the thus prepared composition I was 100:3.5:0.8:0.6:1.1.

(6) Treatment of woolen fabric with organopolysiloxane composition

Two treatment baths containing 4.3% and 2.15% of non-volatile matter, referred to as the baths I and II, respectively, hereinbelow, were prepared by diluting the above prepared composition I with water. The wool cloth after the persulfate treatment was immersed in the bath I or II and squeezed by using a squeezer in such a controlled manner that the wet pickup of the bath liquid after squeezing was about 100%. The wool cloth soaked with the bath liquid was then dried by heating at 100° C. for 3 minutes followed by a heat treatment at 150° C. for 3 minutes to effect curing of the organopolysiloxane composition.

(7) Evaluation of finished cloth

The wool cloth after finishing in the above described manner was subjected to the evaluation test of shrinkproofness according to the procedure specified in JIS L 0217, Item 103, by 20 times repeating washing in a household-type electric washer to record the shrinkage after the 1st, 5th, 10th and 20th times of washing.

Determination of shrinkage

Prior to washing, a 30 cm by 30 cm wide sheet of the wool cloth under testing was folded along two lines each running at a distance of 4 cm from one of the side lines running in the directions of warp and weft and the crease lines were set by pressing with a hot iron. Each of the flaps formed by folding was fixed to the body of the cloth by sewing along the line at a distance of 3 cm from the crease line by using a sewing machine. Pairs of benchmarks each 10 cm apart one from the other were provided by using an unerasable ink on the crease lines and on the flat area at about the center portion of the cloth in both of the warp and weft directions.

After each of the specified numbers of times of washing, the distance L in cm between the benchmarks of each pair was measured and the results of shrinkage in % were recorded as a total of the shrinkages in the directions of warp and weft each calculated by using the equation:

$$\text{shrinkage, } \% = (10 - L)/10 \times 100.$$

The results are shown in Table 1 below.

Evaluation of softness

The wool cloth after the 1st, 5th, 10th and 20th times of washing was examined by hand-touching and the feeling of softness was recorded in 4 ratings of A, B, C and D corresponding to: excellently pleasant feeling of softness; good feeling of softness; somewhat stiff and less soft feeling; and stiff feeling without softness, respectively.

The results are shown in Table 1 under Experiments No. 1 and No. 2 for the baths I and II, respectively.

COMPARATIVE EXAMPLE 1

For comparison, two more sheets of the same wool cloth as used in Example 1, of which one was treated with the bath I used in Example 1 but by omitting the persulfate treatment and the other was subjected to the persulfate treatment but not to the treatment with the bath I or II, were subjected to the test of shrink-proofness by repeated washing and to the test of softness to give the results shown in Table 1 under Experiments No. 3 and No. 4 for the former and latter experiments above, respectively.

EXAMPLE 2

(1) Preparation of an aqueous emulsion of component (A)

Into a reaction vessel equipped with a thermometer, reflux condenser and stirrer were introduced 1000 parts of octamethyl cyclotetrasiloxane and 5 parts of phenyl trimethoxy silane and the mixture was heated at 120° C. for 2 hours under bubbling of dry nitrogen gas to effect dehydration followed by the addition of 0.1 part of potassium hydroxide and further heating at 150° C. for 5 hours under agitation to effect the ring-opening polymerization of the cyclic siloxane oligomer. After cooling to 100° C., the reaction mixture was neutralized by adding 0.4 part of ethylene chlorohydrin to give a dimethyl polysiloxane having three methoxy groups in a molecule.

An aqueous emulsion, referred to as the emulsion A-II hereinbelow, was prepared by vigorously agitating a mixture consisting of 300 parts of the above obtained dimethyl polysiloxane, 50 parts of a polyoxyethylene nonylphenyl ether and 650 parts of water by using a homomixer.

Separately, another aqueous emulsion, referred to as the emulsion A-III hereinbelow, was prepared by the in situ emulsion polymerization method. Thus, a mixture of 350 parts of octamethyl cyclotetrasiloxane, 5 parts of a partial hydrolysis product of N-(2-aminoethyl)-3-aminopropyl methyl dimethoxy silane, 5 parts of methyl triethoxy silane, 40 parts of lauryl trimethyl ammonium chloride and 600 parts of water was vigorously agitated with a homomixer to prepare an aqueous emulsion which was transferred into a reaction vessel equipped with a thermometer and stirrer with admixture of 20 parts of a 5% aqueous solution of potassium hydroxide and heated at 80° C. for 48 hours under agitation to effect the polymerization reaction. After cooling to 30° C., the reaction mixture was neutralized with addition of 3 parts of acetic acid to give the emulsion A-III of a dimethyl polysiloxane having at least three silanolic hydroxy groups and containing an aminoalkyl group in a molecule. The emulsion A-III contained 36.2% of non-volatile matter.

(2) Preparation of an aqueous dispersion of component (B)

An aqueous dispersion of silica, referred to as the dispersion B-II hereinbelow, was prepared by agitating a mixture consisting of 150 parts of a fumed silica filler having a specific surface area of 300 $m^2/g$, 50 parts of a polyoxyethylene nonylphenyl ether and 800 parts of water by using a homomixer.

Separately, another aqueous dispersion of a polymethyl silsesquioxane, referred to as the dispersion B-III hereinbelow, was prepared in the following manner. Thus, an aqueous emulsion was prepared by agitating a mixture of 300 parts of methyl trimethoxy silane, 50 parts of lauryl trimethyl ammonium chloride and 600 parts of water using a homomixer and the emulsion was transferred into a reaction vessel equipped with a thermometer and stirrer with admixture of 50 parts of a 2% aqueous solution of potassium hydroxide and the mixture was agitated at 50° C. for 3 hours to effect the hydrolysiscondensation reaction followed by cooling to 30° C. and neutralization with addition of 1.0 part of acetic acid. The dispersion B-III thus obtained contained 19.7% of non-volatile matter.

(3) Preparation of organopolysiloxane composition

Two organopolysiloxane compositions, referred to as the compositions II and III hereinbelow, were prepared each in the same manner as in the preparation of the composition I in Example 1 excepting replacement of the emulsion A-I with the emulsion A-II, the colloidal silica dispersion B-I with the dispersion B-II and silane D-I with N-(2-aminoethyl)-3-aminopropyl trimethoxy silane, referred to as the silane D-II hereinbelow, for the composition II and replacement of the emulsion A-I with the emulsion A-III, the colloidal silica dispersion B-I with the dispersion B-III and silane D-I with the silane D-II for the composition III and the weight ratios of the components (A):(B):(C):(D):(E) were 100:10:0.8:0.6:1.1 and 100:5:0.8:0.6:1.1 in the compositions II and III, respectively.

Two more organopolysiloxane compositions, referred to as the compositions IV and V hereinbelow, were prepared from the emulsion A-II or A-III, respectively, and the emulsion E in such a proportion that the weight proportion of the components (A):(E) was 100:1.1.

(4) Treatment of wool cloth with organopolysiloxane composition and evaluation of the treated wool cloth Four treatment baths each containing 4.3% of non-volatile matter, referred to as the baths III, IV, V and VI hereinbelow, were prepared by diluting the above prepared aqueous dispersion of the organopolysiloxane compositions II, III, IV and V, respectively, with water.

The same wool cloth as used in Example 1 after the persulfate treatment in the same manner as in Example 1 was treated with one of the baths III, IV, V and VI also in the same manner as in Example 1.

The thus finished wool cloths were subjected to the evaluation tests for the shrink-proofness and softness in the same manner as in Example 1 to give the results under the same criteria as before shown in Table 1 below under Experiments No. 5, No. 6, No. 7 and No. 8 for the baths III, IV, V and VI, respectively.

COMPARATIVE EXAMPLE 2

For comparison, another treatment bath containing 4.3% of non-volatile matter, referred to as the bath VII hereinbelow, was prepared by diluting, with water, a commercially available urethane resin in the form of an aqueous solution as sold for woolen fabric-finishing use. Treatment of the same wool cloth after the persulfate treatment was performed in the same manner as in Example 2 excepting replacement of the bath III, IV, V or VI with the bath VII.

The results of the evaluation tests of the thus finished wool cloth are shown also in Table 1 under Experiment No. 9.

EXAMPLE 3

A treatment bath, referred to as the bath VIII hereinbelow, containing 4.3% by weight of the non-volatile matter was prepared in the same formulation as in the bath IV from the emulsion A-III, dispersion B-II, solution C, silane D-II and emulsion E excepting that the weight proportion of the respective components (A):(B):(C):(D):(E) calculated as the effective ingredients was 100:30:10:5:1.1.

The results of the treatment of a wool cloth after the persulfate treatment conducted with the bath VIII in the same manner as in the preceding examples are also shown in Table 1 below under Experiment No. 10.

TABLE 1

| Experiment No. | | | 1 | 2 | 3 | 4 | 5 | 6 | 7 | 8 | 9 | 10 |
|---|---|---|---|---|---|---|---|---|---|---|---|---|
| Persulfate treatment | | | yes | yes | no | yes | yes | yes | yes | yes | yes | yes |
| Bath No. | | | I | II | I | None | III | IV | V | VI | VII | VIII |
| Shrinkage, % | | | | | | | | | | | | |
| On the crease line | After washing of | 1st time | 0 | 0 | 0 | 2.0 | 0 | 0 | 0 | 0 | 0 | 0 |
| | | 5th time | 0 | 0.2 | 1.4 | 6.9 | 0 | 0 | 0.3 | 0 | 0 | 0 |
| | | 10th time | 0.6 | 1.1 | 3.3 | 9.1 | 1.5 | 0 | 1.5 | 0.7 | 0 | 0 |
| | | 20th time | 1.5 | 2.3 | 7.5 | 18.5 | 1.3 | 0.2 | 3.2 | 1.8 | 0 | 0.2 |
| On the flat area | After washing of | 1st time | 0 | 0 | 0 | 1.2 | 0 | 0 | 0 | 0 | 0 | 0 |
| | | 5th time | 0 | 0 | 0 | 4.2 | 0 | 0 | 0 | 0 | 0 | 0 |
| | | 10th time | 0 | 0.2 | 1.2 | 8.3 | 0 | 0 | 0.5 | 0 | 0 | 0 |
| | | 20th time | 0.5 | 0.8 | 2.6 | 15.1 | 0.7 | 0 | 2.2 | 0.8 | 0 | 0 |
| Softness | | | | | | | | | | | | |
| After washing of | | 1st time | A | A | A | C | A | A | — | A | D | B |
| | | 5th time | A | A | A | D | A | A | — | A | D | B |
| | | 10th time | A | A | B | D | A | A | — | A | D | B |

TABLE 1-continued

| Experiment No. | 1 | 2 | 3 | 4 | 5 | 6 | 7 | 8 | 9 | 10 |
|---|---|---|---|---|---|---|---|---|---|---|
| 20th time | A | B | B | D | B | A | — | B | D | B |

What is claimed is:

1. A method for shrink-proof treatment of a fabric material of keratinous fibers which comprises the successive steps of:

(a) soaking the fabric material with an aqueous solution containing a persulfate compound dissolved therein to effect surface oxidation of the keratinous fibers; and (b) soaking the thus persulfate-treated fabric material with a curable organopolysiloxane composition followed by a heat treatment to effect curing of the composition on the surface of the keratinous fibers, said curable organopolysiloxane composition comprising:

(A) 100 parts by weight of an organopolysiloxane having, in a molecule, at least two hydroxyl or alkoxyl groups bonded to the silicon atoms;

(B) from 0.5 to 50 parts by weight of a silica or an organopolysilsesquioxane in a finely divided form;

(C) from 0.1 to 20 parts by weight of an alkoxy silane compound having an amido group and a carboxyl group in a molecule represented by the general formula $$HOOC—R^1—CO—NH—R^2SiR^3_a(OR^4)_{3-a},$$

in which $R^1$ and $R^2$ are each a divalent hydrocarbon group having 1 to 8 carbon atoms, $R^3$ and $R^4$ are each a monovalent hydrocarbon group having 1 to 20 carbon atoms and the subscript a is 0 or 1;

(D) from 0.1 to 20 parts by weight of an aminoalkyl-containing alkoxy silane compound represented by the general formula $$R^4R^5\text{-}(R^6—NR^7)_b R^8SiR^9_c(OR^{10})_{3-c},$$

in which $R^4$, $R^5$ and $R^7$ are each a hydrocarbon atom or a monovalent hydrocarbon group having 1 to 20 carbon atoms, $R^6$ and $R^8$ are each a divalent hydrocarbon group having 1 to 8 carbon atoms, $R^9$ and $R^{10}$ are each a monovalent hydrocarbon group having 1 to 20 carbon atoms, the subscript b is 0, 1, 2, or 3 and the subscript c is 0 or 1, or an epoxy group-containing alkoxy silane compound represented by the general formula $$Ep—R^{11}SiR^{12}d(OR^{13})_{3-d},$$

in which Ep is an epoxy group, $R^{11}$ is a divalent hydrocarbon group having 1 to 8 carbon atoms, $R^{12}$ and $R^{13}$ are each a monovalent hydrocarbon group having 1 to 20 carbon atoms and the subscript d is 0 or 1; and (E) from 0.01 to 10 parts by weight of a curing catalyst.

2. The method for shrink-proof treatment of a fabric material of keratinous fibers as claimed in claim 1 in which the persulfate compound is selected from the group consisting of potassium persulfate, sodium persulfate and ammonium persulfate.

3. The method for shrink-proof treatment of a fabric material of keratinous fibers as claimed in claim 1 in which the aqueous solution of the persulfate compound contains from 5 to 10% by weight of the persulfate compound.

4. The method for shrink-proof treatment of a fabric material of keratinous fibers as claimed in claim 1 in which the fabric material is soaked with the aqueous solution of the persulfate compound for 30 to 60 minutes.

5. The method for shrink-proof treatment of a fabric material of keratinous fibers as claimed in claim 1 in which the aqueous solution of the persulfate compound has a pH value in the range from 2 to 5.

6. The method for shrink-proof treatment of a fabric material of keratinous fibers as claimed in claim 1 in which the organopolysiloxane as the component (A) has at least one aminoalkyl group bonded to the silicon atom in a molecule.

7. The method for shrink-proof treatment of a fabric material of keratinous fibers as claimed in claim 1 in which the alkoxy silane compound having an amido group and a carboxyl group in a molecule as the component (C) is a reaction product of an aminoalkyl alkoxy silane and an anhydride of a dibasic carboxylic acid.

8. The method for shrink-proof treatment of a fabric material of keratinous fibers as claimed in claim 7 in which the dibasic carboxylic acid is selected from the group consisting of phthalic acid, succinic acid, methyl succinic acid, maleic acid, glutaric acid and itaconic acid.

9. The method for shrink-proof treatment of a fabric material of keratinous fibers as claimed in claim 1 in which the alkoxy silane compound having an amino group or an epoxy group in a molecule as the component (D) is selected from the group consisting of 3-aminopropyl triethoxy silane, N-(2-aminoethyl)-3-aminopropyl methyl dimethoxy silane, N-cyclohexyl-3-aminopropyl trimethoxy silane, 3-morpholinopropyl methyl dimethoxy silane, 3-glycidyloxypropyl methyl dimethoxy silane and 2-(3,4-epoxycyclohexyl)ethyl methyl dimethoxy silane.

10. The method for shrink-proof treatment of a fabric material of keratinous fibers as claimed in claim 1 in which the curing catalyst as the component (E) is selected from the group consisting of metal salts of an organic acid and amine compounds.

11. The method for shrink-proof treatment of a fabric material of keratinous fibers as claimed in claim 1 in which the fabric material after step (b) contains from 0.5 to 10% by weight of the curable organopolysiloxane composition deposited on the surface of the keratinous fibers.

12. The method for shrink-proof treatment of a fabric material of keratinous fibers as claimed in claim 1 in which the heat treatment in step (b) is performed at a temperature of 140° to 160° C. for 2 to 5 minutes.

* * * * *